US008172620B2

(12) United States Patent
Su et al.

(10) Patent No.: US 8,172,620 B2
(45) Date of Patent: May 8, 2012

(54) ELECTRICAL CONNECTOR ASSEMBLY

(75) Inventors: Ping-Sheng Su, Tu-Cheng (TW); Feng-Jun Qi, Kunshan (CN); Jun Chen, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/957,427

(22) Filed: Dec. 1, 2010

(65) Prior Publication Data

US 2011/0130046 A1 Jun. 2, 2011

(30) Foreign Application Priority Data

Dec. 1, 2009 (CN) ..... 2009 2 0316271 U

(51) Int. Cl.
*H01R 24/00* (2011.01)

(52) U.S. Cl. ..... 439/660; 439/607.01

(58) Field of Classification Search ..... 439/660, 439/607.01
See application file for complete search history.

(56) References Cited

U.S. PATENT DOCUMENTS

| | | | | |
|---|---|---|---|---|
| 6,238,240 | B1 * | 5/2001 | Yu | 439/541.5 |
| 6,764,338 | B2 * | 7/2004 | Fang | 439/607.2 |
| 7,837,510 | B1 * | 11/2010 | Hung et al. | 439/660 |
| 8,070,525 | B2 * | 12/2011 | Hou et al. | 439/660 |
| 2011/0070778 | A1 * | 3/2011 | Wan et al. | 439/660 |
| 2011/0130046 | A1 * | 6/2011 | Su et al. | 439/660 |

FOREIGN PATENT DOCUMENTS

CN 2896615 Y 5/2007

* cited by examiner

*Primary Examiner* — James Harvey
(74) *Attorney, Agent, or Firm* — Wei Te Chung; Andrew C. Cheng; Ming Chieh Chang

(57) ABSTRACT

An electrical connector assembly (100), comprises: an insulative housing (2) having a plurality of passageways (24) arranged into a first row and a second row; a plurality of terminals (3) received into the corresponding passageways of the insulative housing and divided into a first terminal group (31) and a second terminal group (32), and each terminal having a terminating section (303) at a rear end thereof, the terminating sections of the plurality of terminals located on a common plane; a spacer (4) assembled to a rear end of the insulative housing and having a row of grooves (421) formed on an upper surface thereof, the terminating sections of the terminals passing through the spacer and received into the corresponding grooves of the spacer; and a metallic shell (5) assembled to an outer surface of the insulative housing and the spacer.

17 Claims, 9 Drawing Sheets

ELECTRICAL CONNECTOR ASSEMBLY

FIELD OF THE INVENTION

The present invention relates to an electrical connector, and more particularly to an electrical connector which can be quickly electrically connected to a cable.

DESCRIPTION OF PRIOR ART

China Pat. No. 2896615Y issued to Huang on Jul. 20, 2005 discloses an electrical connector. The electrical connector comprises an insulative housing, a first and second terminal groups received into the insulative housing and a spacer assembled to a rear end of the insulative housing and separated the first and second terminal groups in a up to down direction. The first and second terminal groups respectively comprises a plurality of first and second terminals. Each first terminal defines a soldering portion disposed on a top surface of the spacer. Each second terminal defines a soldering portion disposed on a bottom surface of the spacer. And it needs two-times soldering when the electrical connector electrically connected with a cable. Firstly, soldering a plurality of conductors of the cable to the soldering portions of the first terminals. Secondly, soldering a plurality of conductors of the cable to the soldering portions of the second terminals. Thus, it needs more soldering times to achieve the electrically and mechanically connection between the electrical connector and the cable.

As discussed above, an improved electrical connector assembly overcoming the shortages of existing technology is needed.

SUMMARY OF THE INVENTION

Accordingly, an object of the present invention is to provide an electrical connector which is quickly soldered to a cable.

In order to achieve the above-mentioned objects, an electrical connector assembly, comprises: an insulative housing having a plurality of passageways arranged into a first row and a second row; a plurality of terminals received into the corresponding passageways of the insulative housing and divided into a first terminal group and a second terminal group, and each terminal having a terminating section at a rear end thereof, the terminating sections of the plurality of terminals located on a common plane; a spacer assembled to a rear end of the insulative housing and having a row of grooves formed on an upper surface thereof, the terminating sections of the terminals passing through the spacer and received into the corresponding grooves of the spacer; and a metallic shell assembled to an outer surface of the insulative housing and the spacer.

Other objects, features and advantages of the invention will be apparent from the following detailed description taken in connection with the accompanying drawings.

DETAILED DESCRIPTION OF PREFERRED EMBODIMENTS

Figure 1:
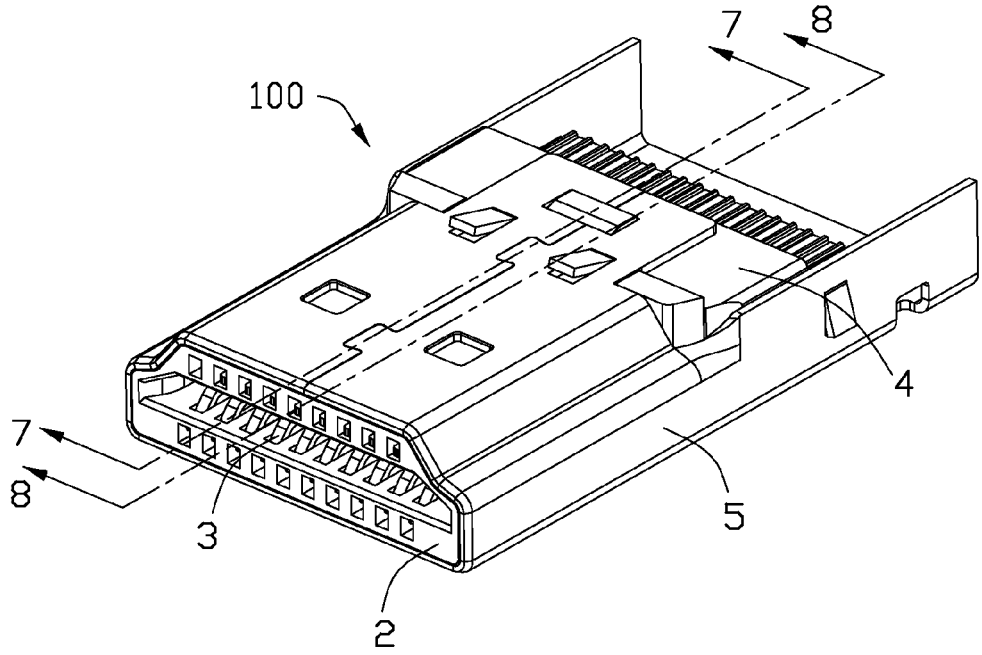
FIG. 1 is a perspective view of an electrical connector assembly in accordance with the present invention.

Reference will now be made to the drawing figures to describe the present invention in detail.

Figure 3:
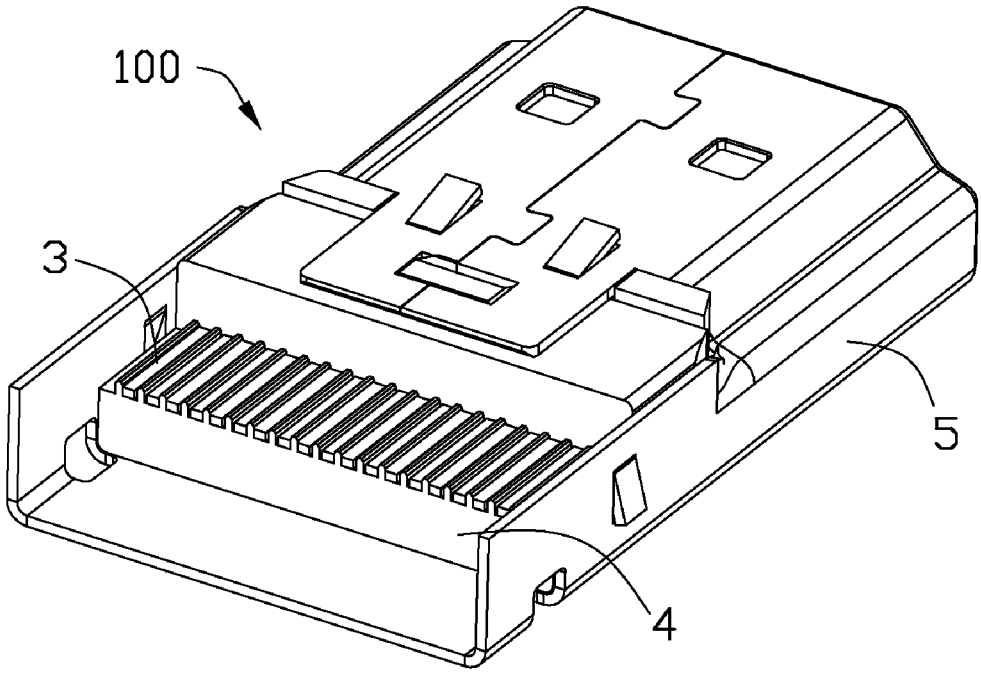
FIG. 3 is another perspective view of the electrical connector assembly in accordance with the present invention.

Please refer to FIGS. 1 and 3, an electrical connector assembly 100 made in accordance with the present invention comprises an insulative housing 2, a plurality of terminals 3 disposed in the insulative housing 2, a spacer 4 assembled to a rear end of the insulative housing 2 and a metallic shell 5 assembled to an outer surface of the insulative housing 2 and the spacer 4.

Figure 2:
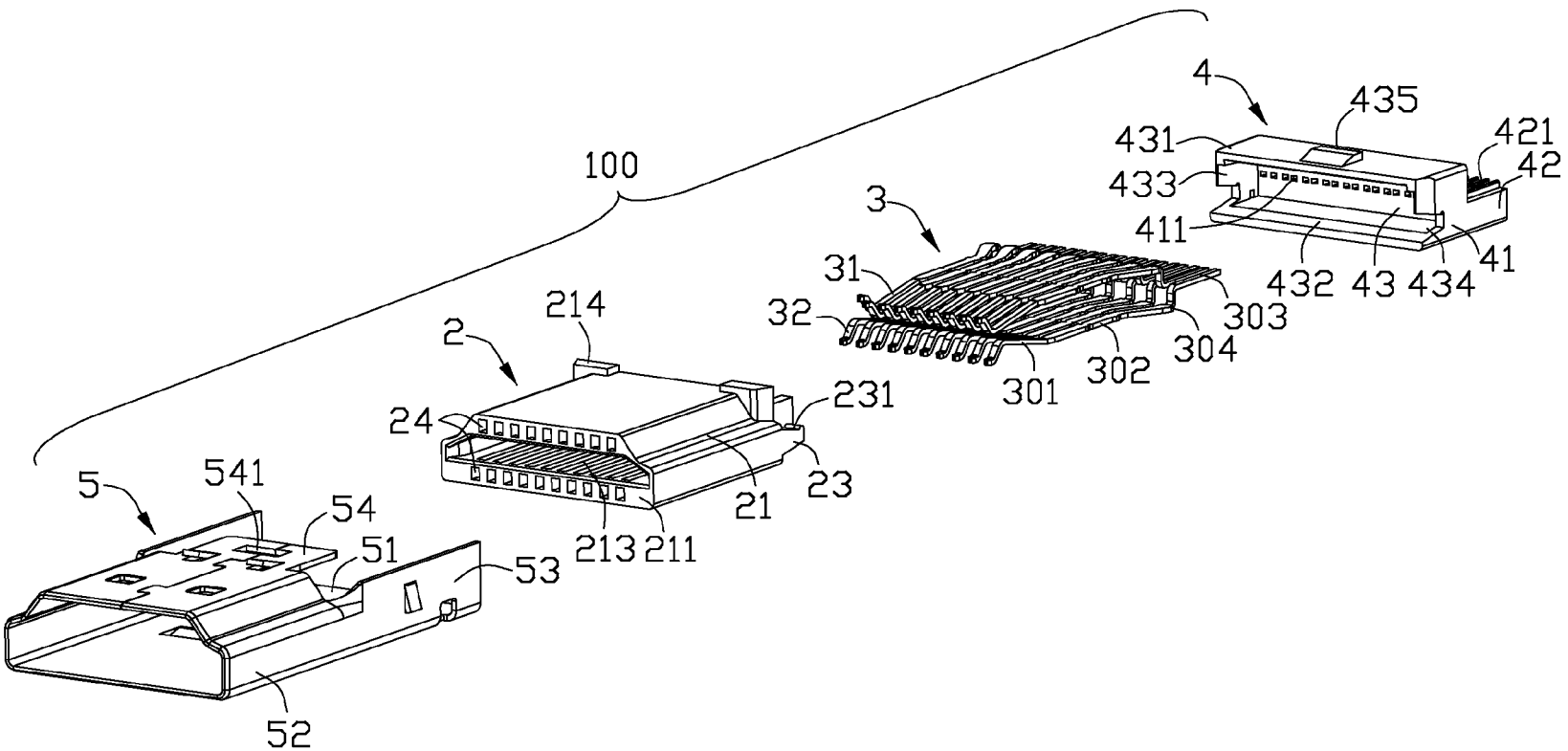
FIG. 2 is an exploded, perspective view of the electrical connector assembly of FIG. 1.
Figure 4:
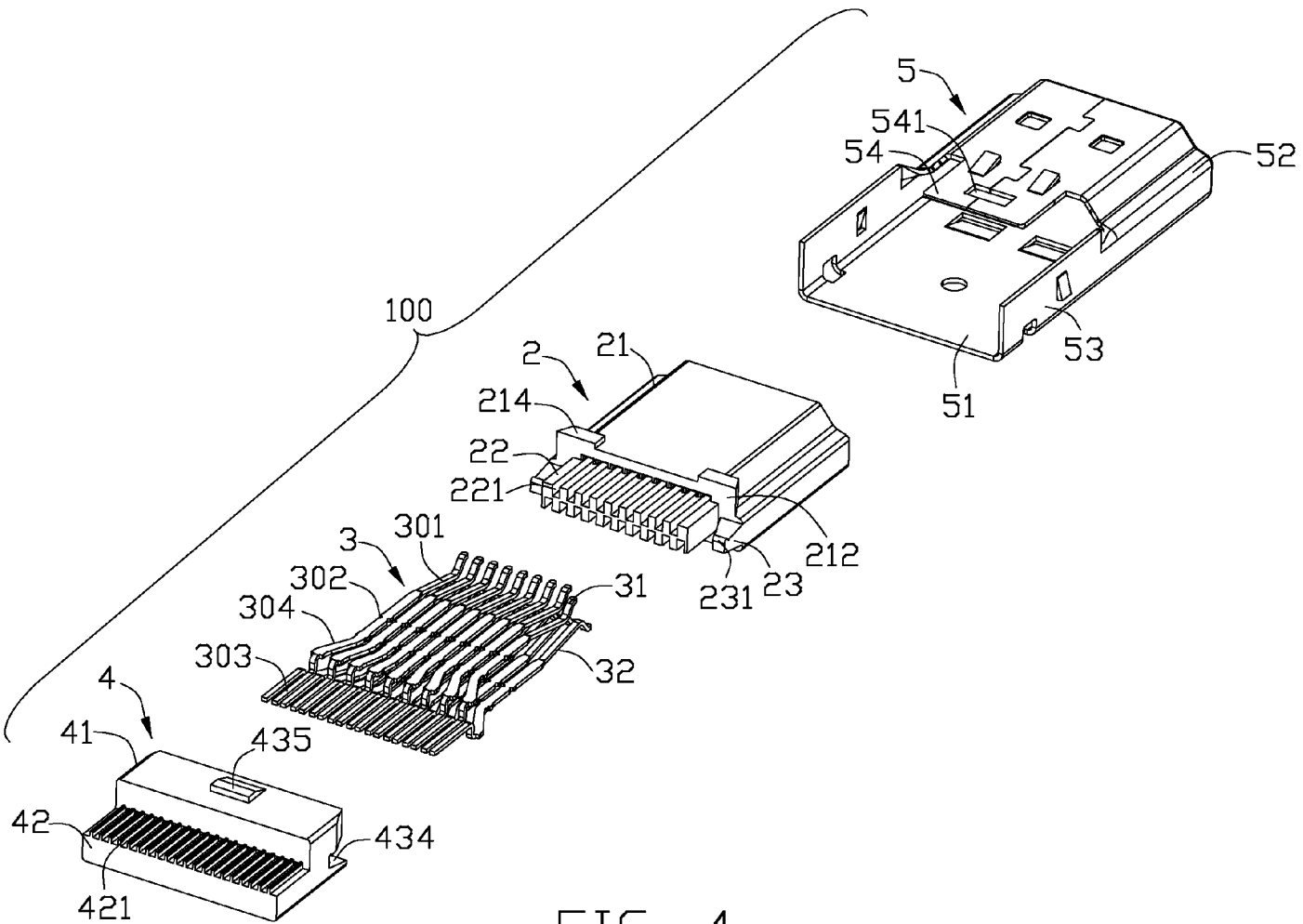
FIG. 4 is an exploded, perspective view of the electrical connector assembly of FIG. 3.
Figure 5:
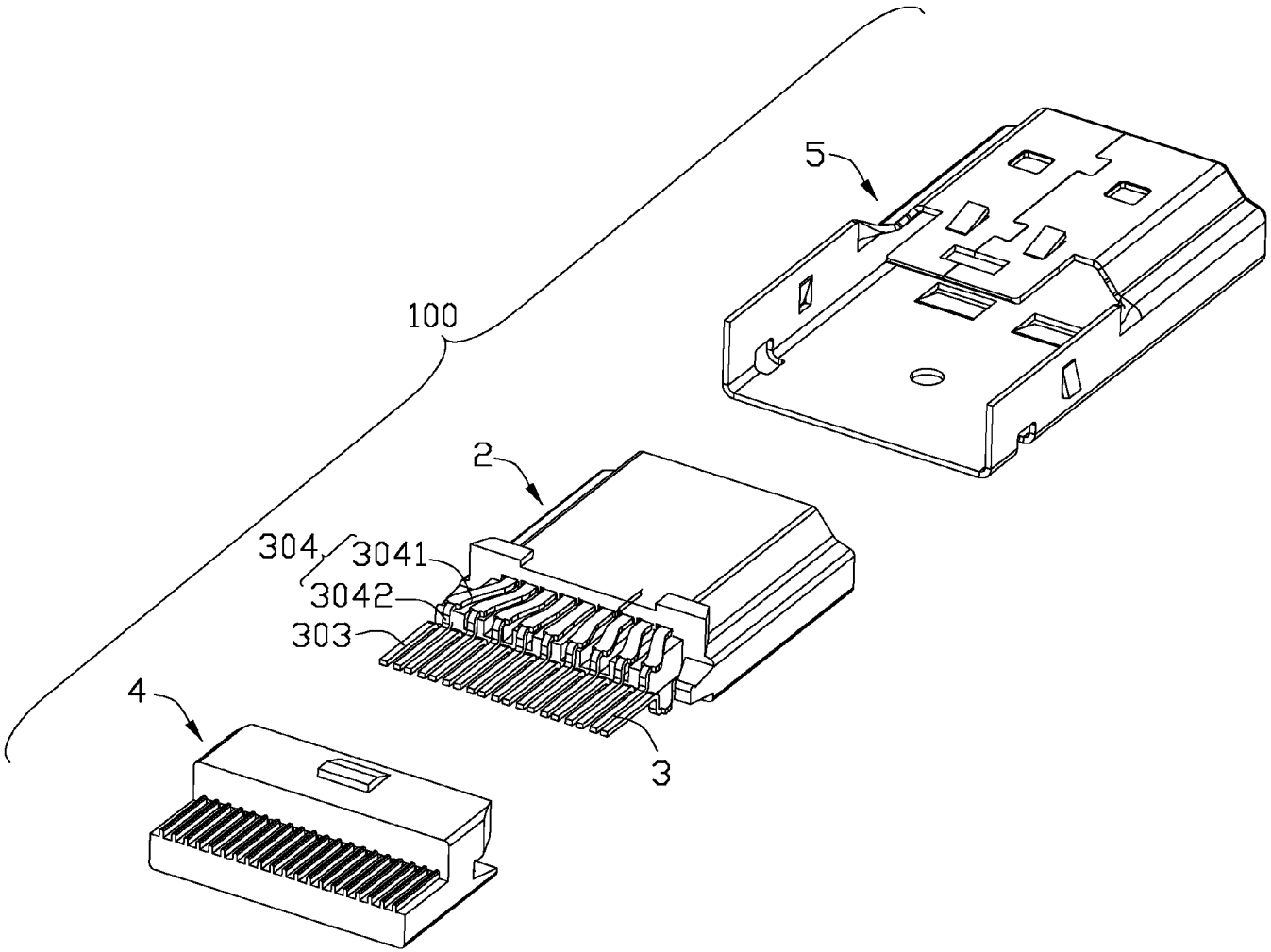
FIG. 5 is a partial exploded, perspective view of the electrical connector assembly of FIG. 3.
Figure 6A:
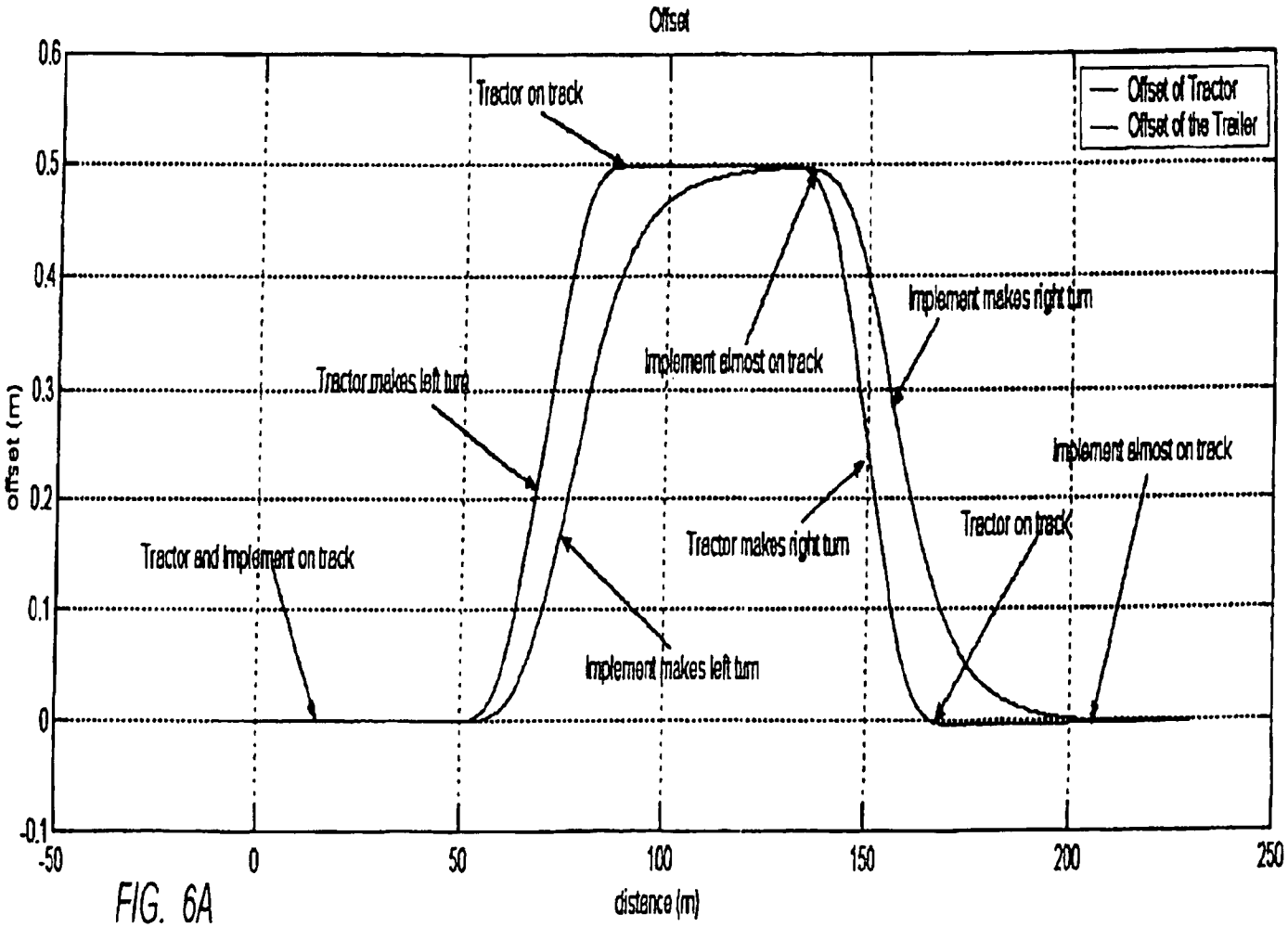
FIG. 6A (PRIOR ART)
FIG. 6 is another partial exploded, perspective view of the electrical connector assembly of FIG. 5.
Figure 6B:
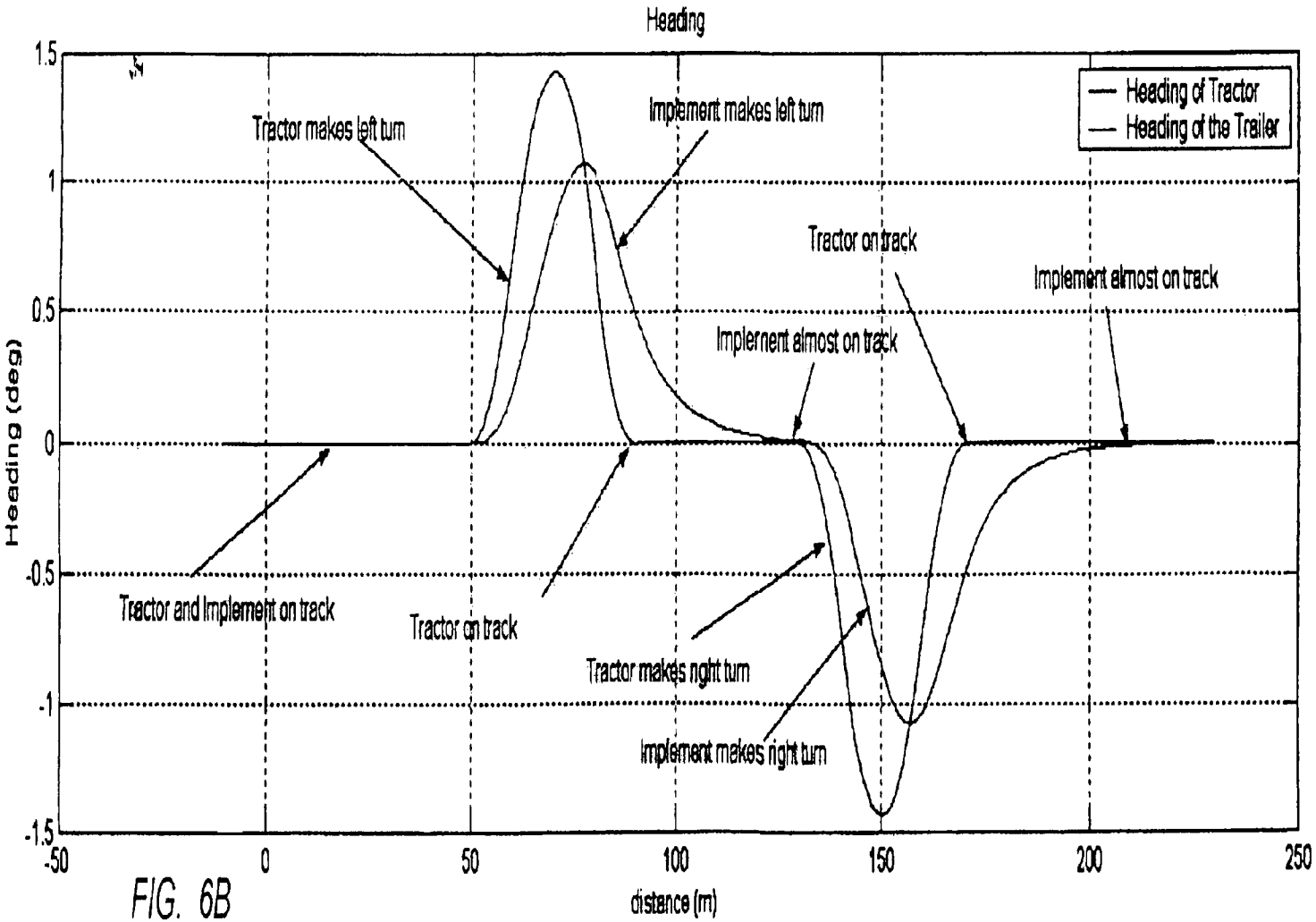
FIG. 6B (PRIOR ART)
Figure 7:
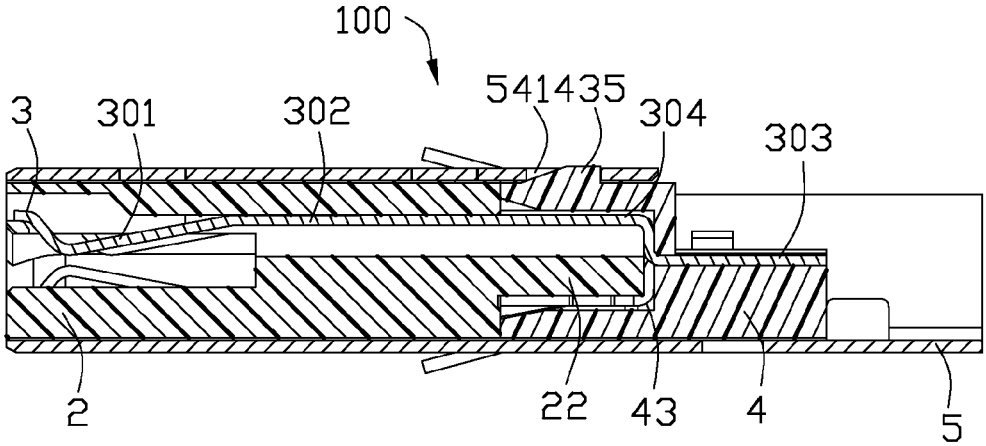
FIG. 7 is a cross section view of electrical connector assembly of FIG. 1 taken along line 7-7.
Figure 8:
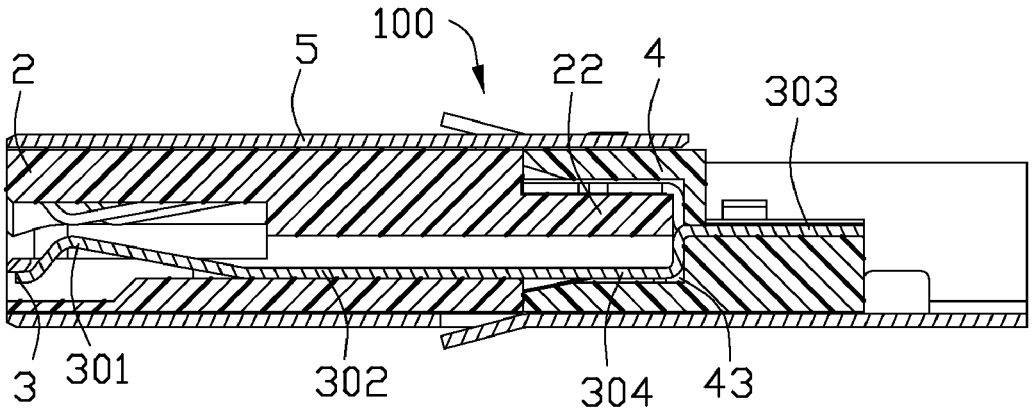
FIG. 8 is a cross section view of the electrical connector assembly of FIG. 1 taken along line 8-8.

Referring to FIGS. 2 to 4, the insulative housing 2 defines a main portion 21 with a front surface 211 and a rear surface 212 opposite to the front surface 211, a rear portion 22 extending rearwardly from the rear surface 212 of the main portion 21 and a pair of latching portions 23 extending rearwardly from the rear surface 212 of the main portion 21 and disposed at two sides of the rear portion 22. The insulative housing 2 defines a receiving cavity 11 extending rearward from the front surface 211 of the main portion 21 for a distance. A plurality of passageways 24 are formed on a top and bottom inner surfaces of the receiving cavity 11 and communicated with the receiving cavity 11. The plurality of passageways 24 are divided into a first row and a second row. Each passageway 24 extends from the front surface 212 to the rear surface 212 of the main portion 21 of the insulative housing 2. The main portion 21 defines a pair of protrusions 15 formed on a top surface thereof for limiting a rearward movement of the metallic shell 5. The pair of protrusions 15 are disposed at a rear end and two sides of the main portion 21 of the insulative housing 2. The rear portion 22 defines a plurality of slots 221 formed on two opposite top and bottom surfaces thereof and communicated with the plurality of passageways 24 along a front to rear direction. Each slot 221 is in alignment with a corresponding passageway 24 along a front to rear direction. Each slot 221 has a determinated depth for guiding a front end of each terminal 3 into the passageway 24. Each latching portions 23 defines a barb 231 formed on top surface thereof for locking with the spacer 4.

Referring to FIGS. 2 and 4 to 8, the plurality of terminals 3 are divided into a first terminal group 31 and a second terminal group 32. The first terminal group 31 comprises a plurality of first terminals 3 arranged along a transverse direction and spaced apart with each other. The second terminal group 32 comprises a plurality of second terminals 3 arranged along a transverse direction and spaced apart with each other. And, the plurality of first terminals 3 are received into the first row of passageways 24 and positioned with the insulative housing 2. The plurality of second terminals 3 are received into the second row of receiving passageways 24 and positioned with the insulative housing 2. Each terminal 3 defines an elastic and curved mating section 301 disposed at a front end thereof, an engaging section 302 extending rearwardly from the mating section 301 and interfered with the passageway 24, a terminating section 303 disposed at a rear end thereof and a connecting section 304 disposed between the engaging section 302 and the terminating section 303. The connecting section 304 of each first terminal 3 includes a horizontal segment 3041 and a vertical segment 3042 that is a spanning section extending downwardly from a rear end of the horizontal segment 3041. At least one horizontal segment 3041 of the connecting section 304 of the first terminal 3 extends outwardly from the engaging section 302 and is angled with the engaging section 302 in a horizontal plane. The connecting section 304 of each second terminal 3 includes a horizontal segment 3041 and a vertical segment 3042 extending upwardly from a rear end of the horizontal segment 3041. At least one horizontal segment 3041 of the connecting section 304 of the second terminal 3 extends outwardly from the engaging section 302 and is angled with the engaging section 302 in another horizontal plane. The terminating sections 303 of the first and second terminals 3 are arranged on a common horizontal plane. The terminating sections 303 of the first and second terminals 3 are arranged in an alternate manner.

Referring to FIGS. 2, 4 and 7 to 8, the spacer 4 comprises a base portion 41 and a supporting portion 42 extending rearwardly from a lower side of a rear surface of the base portion 41. The base portion 41 of the spacer 4 defines a recess 43 formed on a front surface thereof. The recess 43 is enclosed by a top wall 431, a bottom wall 432 and a pair of side walls 433. Each side wall 433 defines a cutout 434 for cooperating with the latching portion 23. The top wall 431 defines a protruding piece 435 for cooperating with the metallic shell 5. The base portion 41 defines a plurality of through holes 411 communicated with the recess 43. The supporting portion 42 defines a plurality of grooves 421 arranged along a transverse direction and respectively in alignment with a corresponding through hole 411 along a front to rear direction. The plurality of grooves 421 are used for accommodating the terminating sections 303 of the terminals 3.

Referring to FIGS. 1 to 4 and 7, the metallic shell 5 defines a bottom plate 51, a box portion 52 formed at a front portion of the bottom plate 51 and a pair of side plates 53 extending upwardly from two sides of the bottom plate 51 and connected with two sides of the box portion 52. The boxing portion 52 is used for accommodating the main portion 21 of the insulative housing 2. The metallic shell 5 further defines a locking piece 54 extends rearwardly from the box portion 52 for locking with the insulative housing 2. The locking piece 54 defines an aperture 541 for cooperating with the protruding piece 435 of the insulative housing 2.

Referring to FIGS. 1 to 8, the assembling process of the electrical connector assembly 100 made in according to the present invention starts from assembling a plurality of terminals 3 to the insulative housing 2 along a rear to front direction. The mating section 301 and engaging section 302 of each terminal 3 are received into the passageway 24. And, a portion of the mating section 301 extends into the receiving cavity 213 of the insulative housing 2. The connecting section 304 and terminating section 303 extend beyond the rear surface 212 of the main portion 21 of the insulative housing 2. The horizontal segments 3041 of the connecting sections 304 of the terminals 3 are disposed at opposite upper and lower sides of the rear portion 22 of the insulative housing 2 and supported by the rear portion 22 of the insulative housing 2. The vertical segments of the connecting sections 304 of the terminals 3 are disposed in back of the rear portion 22 of the insulative housing 2. The terminating sections 303 of the terminals 3 are also disposed in back of the rear portion 22 of the insulative housing 2 and located on a common horizontal plane.

After the plurality of terminals 3 are assembled to the insulative housing 2, then assembling the spacer 4 to a rear end of the insulative housing 2. The rear portion 22 of the insulative housing 2 is received into the recess 43 of the spacer 4. A pair of latching portions 23 are received into the corresponding cutouts 434 of the spacer 4 and locked with the spacer 4. And, the terminating sections 303 of the terminals 3 pass through the through hole 411 and received into the grooves 421 of the spacer 4.

Finally, assembling the metallic shell 5 to the insulative housing 2 along a front to rear direction. Thus, the main portion 21 of the insulative housing 2 is received into the box portion 52 of the metallic shell 5. The protruding piece 435 of the spacer 4 is received into the aperture 541 of the locking piece 54 of the metallic shell 5. Thus, the metallic shell 5 is locked with the insulative housing 2.

After the above assembling steps, the entire process of assembling the electrical connector assembly 100 is finished.

It should be noted that the terminating sections 303 of the terminals 3 of the electrical connector assembly 100 are located on a common plane and supported by the spacer 4. So, the terminals 3 are electrically and mechanically connected to a cable only through one-time soldering. Thus, the electrical connector assembly 100 is easily and quickly electrically connected to the cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing having a plurality of passageways arranged into a first row and a second row;

a plurality of terminals received into the corresponding passageways of the insulative housing and divided into a first terminal group and a second terminal group, and each terminal having a terminating section at a rear end thereof, the terminating sections of the plurality of terminals located on a common plane;

a spacer assembled to a rear end of the insulative housing and having a row of grooves formed on an upper surface thereof, the terminating sections of the terminals passing through the spacer and received into the corresponding grooves of the spacer; and a metallic shell assembled to an outer surface of the insulative housing and the spacer.

2. The electrical connector assembly as recited in claim 1, wherein the first terminal group has a plurality of first terminals, the second terminal group has a plurality of second terminals, the terminating sections of the first and second terminals are arranged alternate.

3. The electrical connector assembly as recited in claim 2, wherein the insulative housing defines a main portion and a rear portion extending rearwardly from a rear surface of the main portion, the first and second rows of passageways are formed in the main portion of the insulative housing.

4. The electrical connector assembly as recited in claim 3, wherein the spacer has a base portion having a recess formed on a front surface thereof and a supporting portion extending rearwardly from the base portion, the rear portion of the insulative housing is received into the recess, the plurality of grooves are formed on a top surface of the supporting portion.

5. The electrical connector assembly as recited in claim 2, wherein the insulative housing defines a pair of latching portions disposed at two sides of the rear portion, the spacer defines a pair of cutouts at two sides thereof, the pair of latching portions are received into the pair of cutouts and locked with the spacer.

6. The electrical connector assembly as recited in claim 2, wherein the insulative housing defines a receiving cavity extending rearwardly from a front surface thereof for a distance, a plurality of passageways are formed on two opposite inner surface of the receiving cavity and communicated with the receiving cavity.

7. The electrical connector assembly as recited in claim 6, wherein each terminal further defines an elastic mating section formed on a front end thereof and extending into the receiving cavity, an engaging section extending rearwardly and interfered with the passageway and a connecting section extending out of the passageway and disposed between the engaging section and the terminating section.

8. The electrical connector assembly as recited in claim 7, wherein the connecting section of each terminal comprises a horizontal segment and a vertical segment, and at least one horizontal segment of the first and second terminal extends outwardly and is angled with the engaging section in a horizontal plane.

9. The electrical connector assembly as recited in claim 6, wherein the horizontal segments of the first and second terminals are respectively disposed at two sides of the rear portion of the insulative housing.

10. The electrical connector assembly as recited in claim 3, wherein the metallic shell defines a box portion surrounding the main portion of the insulative housing, a bottom plate supporting the spacer and a locking piece cooperated with a protruding piece of the spacer.

11. The electrical connector assembly as recited in claim 3, wherein the rear portion of the insulative housing defines a plurality slots formed on opposite top and bottom surfaces, each slot is in alignment with a corresponding passageway along a front to rear direction.

12. An electrical connector assembly comprising:

an insulative housing having a main portion with a front and a rear surface;

a plurality of first and second terminals disposed in the insulative housing and arranged along a transverse direction, each first and second terminal respectively having a mating section at a front end thereof and a terminating section at a rear end thereof, the mating sections of the first terminals spaced apart with the mating sections of the second terminals in an up to down direction, the terminating sections of the first and second terminals located in a common plane;

a spacer assembled to a rear end of the insulative housing and having a plurality of grooves on an upper surface thereof, the terminating sections of the first and second terminals received into the grooves; and a metallic shell assembled to the insulative housing and the spacer.

13. The electrical connector assembly as claimed in claim 12, wherein the terminating sections of the first and second terminals are arranged alternate.

14. The electrical connector assembly as claimed in claim 13, wherein the insulative housing defines a rear portion extending rearwardly form the rear surface of the main portion, the spacer defines a recess formed on a front surface thereof, the rear portion received into the recess.

15. The electrical connector assembly as claimed in claim 13, wherein the insulative housing defines a pair of latching portions locked with the spacer.

16. The electrical connector assembly as claimed in claim 13, wherein the insulative housing defines a receiving cavity extending rearwardly from the front surface of the main portion for a distance.

17. An electrical connector assembly comprising:

an insulative housing defining a mating port;

upper and lower rows of contacts disposed in the housing;

each of said upper row of contacts including a front deflectable upper contacting section exposed on an upper side of the mating port, an upper retention section located behind the upper contacting section for retaining the corresponding one of the upper row of contacts to the housing, an upper laterally outwardly spanning section located behind the upper retention section, and an upper tail section downwardly offset from the upper retention section in a vertical direction;

each of said lower row of contacts including a front deflectable lower contacting section exposed on a lower side of the mating port, a lower retention section located behind the lower contacting section for retaining the corresponding one of the lower rows of contacts to the housing, a lower laterally outwardly spanning section located behind the lower retention section, and a lower tail section upwardly offset from the lower retention section in the vertical direction; wherein the upper tail sections of the upper row of contacts and the lower tail sections of the lower row of contacts are alternatively arranged in a single row;

further including a spacer located behind the housing, wherein said spacer defines a plurality of through holes and corresponding grooves to receive the corresponding upper and lower tail sections; a metallic shell assembled to both the insulative housing and the spacer.

* * * * *